United States Patent [19]

Cavallari

[11] 4,260,270

[45] Apr. 7, 1981

[54] MOSAIC PRINTING HEAD

[75] Inventor: Pier G. Cavallari, Novara, Italy

[73] Assignee: Honeywell Information Systems Italia, Caluso, Italy

[21] Appl. No.: 74,264

[22] Filed: Sep. 11, 1979

[30] Foreign Application Priority Data

Sep. 11, 1978 [IT] Italy ..... 27496 A/78

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 3,893,220 7/1975 Bittner ..... 400/124 X 4,049,107 9/1977 Murat ..... 400/124

4,140,406 2/1979 Wolf et al. ..... 400/124

*Primary Examiner*—Paul T. Sewell

*Attorney, Agent, or Firm*—Ronald T. Reiling; Nicholas Prasinos

[57] ABSTRACT

An impact matrix printing head for use in a computer printer. The printing head utilizes a unique design to provide an unitary needle guiding assembly and an unitary electromagnet assembly which can each be independently removed from the printer head without the need to disassemble. The printer head includes adjustments for the air gap of the electromagnet assembly and adjustments for the needle position, both initially and after needle wear has occurred.

3 Claims, 5 Drawing Figures

MOSAIC PRINTING HEAD

BACKGROUND OF THE INVENTION

1. Field of the Invention

This invention relates to an improved wire matrix print head. A wire matrix print head generally includes a needle guide assembly and a plurality of electromagnetic structures coupled to the guide assembly. Each electromagnetic structure is mounted on an electromagnetic support and comprises a magnetic circuit formed by two pole pieces connected by a yoke and by a movable armature which completes the magnetic circuit. It further includes at least a coil wound around one of the two pole pieces.

2. Description of the Prior Art

An example of a wire matrix print head is given in U.S. Pat. No. 4,051,941. Note that each of the electromagnetic structures acts on one of the printing needles. Furthermore each movable armature is provided with at least an arm which protrudes externally to the electromagnetic structure and operates on an actuating arm for the associated needle.

Such wire print heads must be very inexpensive and simple in construction. At the same time they must allow for precise adjustment, in particular of the air gap width in the electromagnetic structure with the armature at rest and on the distance of the needle's tip from the platen when needles are at rest. Italian Pat. No. 956,585 describes a wire matrix print head where such adjustments can be individually performed on each electromagnetic structure and related needle. However such print head is complex and expensive. In contrast the number of constructive elements and constructive complexity are reduced to a minimum, in the wire matrix print head disclosed in U.S. Pat. No. 4,051,941 at the expense of adjustability and calibration.

Further the constructive arrangement shown in U.S. Pat. No. 4,051,941 is only suitable for print heads where the electromagnetic structures are distributed circumferentially in a uniform way along a supporting member. In fact, the constructive arrangement provides for a disk shaped armature retainer, which is unitary for the whole set of armatures, and provides both biasing of the armatures at its periphery as well as the rest surface for the armatures which defines the air gap width. Such armature retainer is fixed to the electromagnetic structure support by means of a screw, central to it. Clearly such screw provides an imperfect constraint and the forces exerted on a sector of the armature retainer give a resulting force which is eccentric to the central screw causing a rotation (not negigible even if small) of the armature retainer at the constraint, with consequent slack at the retaining position and change of the air gap width.

SUMMARY OF THE INVENTION

These disadvantages are overcome by the printing head of the present invention, where the structure is remarkably simple and inexpensive, but it also contains provisions for air gap adjustment, needles adjustment and wear recovery. Further a unitary armature retainer can be used without inconvenience even if the electromagnetic structures are located radially around a center on a limited circumference sector for better print visibility.

According to the invention these advantages are obtained by utilizing a print head design having an armature retainer which is firmly pressed against an element of the electromagnetic support by a central cap and an interpositioned resilient ring member. The central cap is fixed to the electromagnetic support by means of a plurality of locking screws. The central cap performs the function of stopping the armatures in their rest position. The central gap's distance from the electromagnetic support can be adjusted by action on the locking screws, thus compressing in variable amount the intermediate resilient member. In this way the air gap width can be accurately adjusted and calibrated.

The disclosed structure allows for very precise machining of the electromagnetic structures, thus providing a perfect coplanarity of the air gaps, and overcome the requirement of individual adjustment of the air gaps at the advantage and convenience of collective adjustment. The printing head is further provided with locking means for adjustment of the distance between the printing head and the platen and for adjustment for the wear of the needles at their printing ends, due to the use of the printing head. Finally, the structure of the printing head as a whole results from the simple and inexpensive assembling of functional structural groups which make it particularly easy to assemble and to replace the parts in case of breaks or failures.

BRIEF DESCRIPTION OF THE DRAWINGS

These and other features will appear more clearly from the following description of a preferred form of the invention and from the accompanying drawings where.

DESCRIPTION OF THE PREFERRED EMBODIMENT

Figure 1:
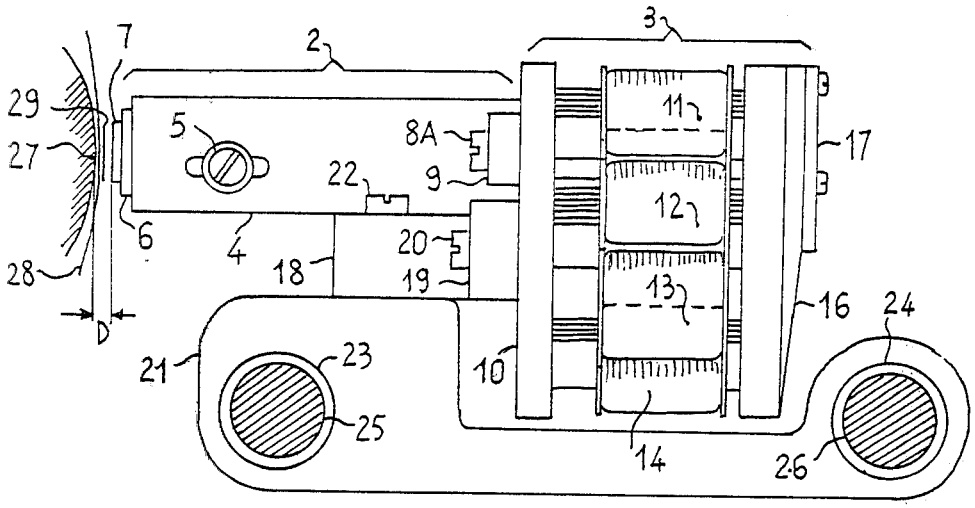
FIG. 1 is a side view of a printing head according to the invention.

Referring to FIG. 1, it shows in side view a print head according to the invention comprising a needle guiding assembly 2 and an electromagnet assembly 3. The needle guiding assembly comprises a frame 4 having a bracket 6, fixed to the frame by a screw 5, which supports a guide for the printing ends of the needles. The guide for the printing ends of the needles is generally formed by a pair of suitably-shaped ruby plates 7 shown in FIG. 1.

The needle guiding assembly 2 is fixed to the electromagnetic assembly 3 by means of two screws (in FIG. 1 the head 8A of one of such screws is visible) which lock two brackets 9 formed on the sides of frame 4 against the electromagnetic assembly 3. The electromagnetic assembly 3 comprises a supporting disk 10, to which a suitable number of electromagnets, such as 11, 12, 13, 14 are fixed, an internal bushing (not visible) fixed by calking or shrinkage in a central opening of disk 10, an armature retainer 16 and a central cap 17.

A socket 18, provided with two side brackets 19, is fixed by screws 20 to the electromagnetic supporting disk 10. For purposes of easier manufacturing of the elements, such socket is separate from disk 10, but it could be integral to disk 10. In turn, socket 18, and as a consequence the whole printing head, is fixed to a print carriage 21 by means of screws 22.

The printing carriage is provided with driving bushings 23, 24 inserted onto two parallel guiding bars 25 and 26, so that the carriage and therefore the print head may slide in the direction of said bars, perpendicular to the plane of the drawing. The carriage and guiding bars are part of the printer frame, which is not shown.

In FIG. 1 it can be seen that the external surface of the ruby plates 7 is placed at a distance D from a platen 27. A paper printing support member 28 and an inked ribbon 29 are interposed between platen 27 and ruby plates 7. Distance D must be suitably adjusted to leave a certain allowance between platen and print head, but at the same time it must be kept to a minimum in order to keep to a minimum the stroke of the printing needles. It is known that the high operating speed of the needles is obtained only if the stroke of the needles is minimum. At the same time the end of the needles at rest must not protrude beyond the rubies because it would cause needle wear and considerable wear of the inked ribbon.

Figure 2:
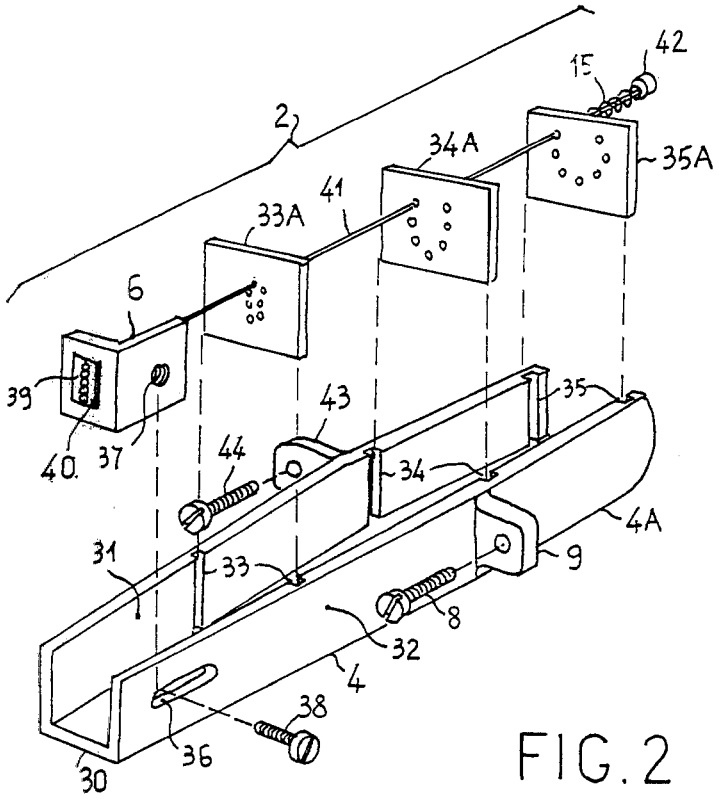
FIG. 2 is a perspective, exploded view of the elements which form a needle guiding assembly of the printing head according to the invention.

FIG. 2 shows in perspective exploded view and with greater detail the needle guiding assembly 2. The needle guiding assembly 2 comprises a frame or elongated body 4 having a generally C-shaped section which is tapered towards one end 30 where bracket 6 is mounted. Such frame, which is opened in the upper side as shown in FIG. 2 (but in alternative it could be open on the lower side) may be obtained by casting or preferably by plastic molding.

Internally to frame 4, on sides 31 and 32 there is a certain number of vertical grooves 33, 34, 35. Such grooves are to receive needle guiding diaphragms 33A, 34A, 35A. One side 32 of the frame (but alternatively the other one or the bottom even) has an elongated opening 36 intended to receive a locking screw 38 engaging with a threaded seat 37 of bracket 6. Opening 36 is elongated in a direction perpendicular to the plane of impression so that bracket 6 may be fixed to frame 4 at a variable and adjustable distance from the platen.

Each of the diaphragms 33A, 34A, 35A is provided with a number of openings equal to the number of needles to be driven with the openings being disposed over a suitable area of the diaphragms as illustrated. The closer the diaphragms are to end 30 of body 4 the closer the openings approximate a vertical distribution.

Guiding member 7 consists of two rubies 39 and 40 having a vertical slot, in which the needles are inserted and guided in vertical alignment.

In FIG. 2 one needle 41 only is shown with a head 42. For each needle a compression spring 15 is inserted between the needle head 42 and diaphragm 35A. The springs tend to keep the needles in a rest, retracted position and the heads apart from the diaphragm.

Frame 4 is provided on the sides with two brackets 9, 43, each having an opening for receiving a screw 8, 44 respectively. Screws 8, 44 are used to fix the guide assembly 4 to the electromagnet assembly 3. On the opposite end of where bracket 6 is mounted, frame 4 extends beyond wings 9, 43 with an appendix 4A, preferably with an externally cylindrical shape. This appendix fits in a corresponding central opening of the electromagnet supporting disk 10 and internally to a bushing which is part of the electromagnetic assembly 3.

Figure 3:
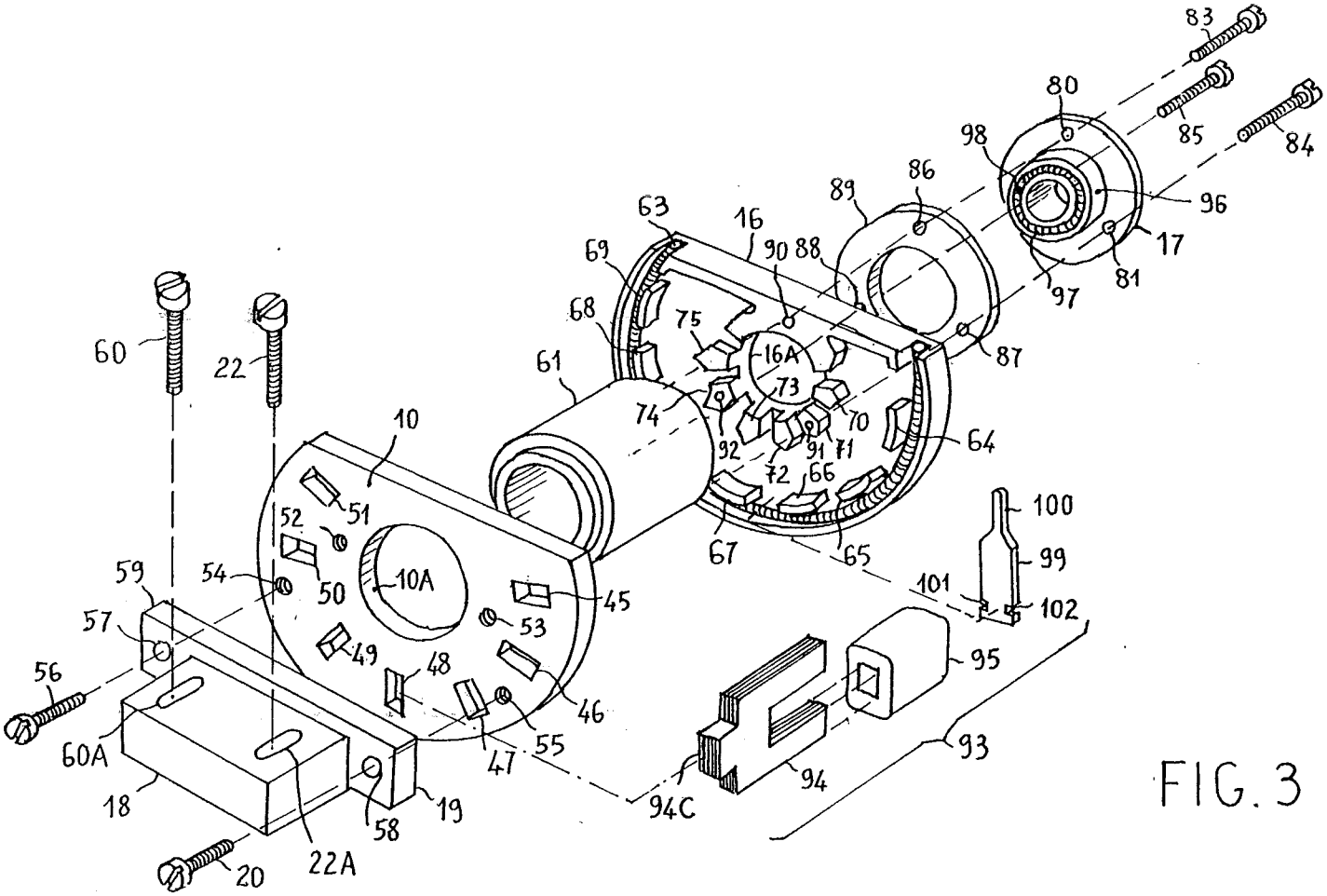
FIG. 3 is a perspective, exploded view of the elements which form an electromagnetic assembly of the printing head according to the invention.

FIG. 3 shows in perspective exploded view an electromagnet assembly 3. The electromagnet supporting disk 10 consists of a ring-shaped member in the form of circular segments having a central round opening 10A. It contains a suitable number of rectangular openings 45–51; each of which receives an appendix provided in each magnetic core. The openings 45–51 are radially distributed around the disk centre and are uniformly spaced in a convenient circular sector of the disk 10. Two threaded openings 52, 53 enable screws 44 and 8 (FIG. 2) to engage in said openings and to fix the guiding assembly 2 to the electromagnet assembly. Two other threaded openings 54 and 55 receive screws 56 and 20, which by previous insertion in openings 57, 58 provided in brackets 59 and 19 of socket 18, connect together socket 18 and supporting disk 10.

Socket 18 is provided with two openings 60A, 22A, elongated in the direction perpendicular to the plane of impression and adapted to receive screws 60 and 22 which are screwed in suitable threaded seats of the printing carriage. Thus socket 18 (and the whole print head) is fixed to the printing carriage and allows for adjustment of the print head distance from the platen.

A cylindrical bushing 61 is fixed by shrinkage or calking in the central opening 10A of the supporting disk 10. An armature retainer 16 is placed on the bushing plane surface opposite to the bushing end which is fixed to the disk 10.

Figure 5:
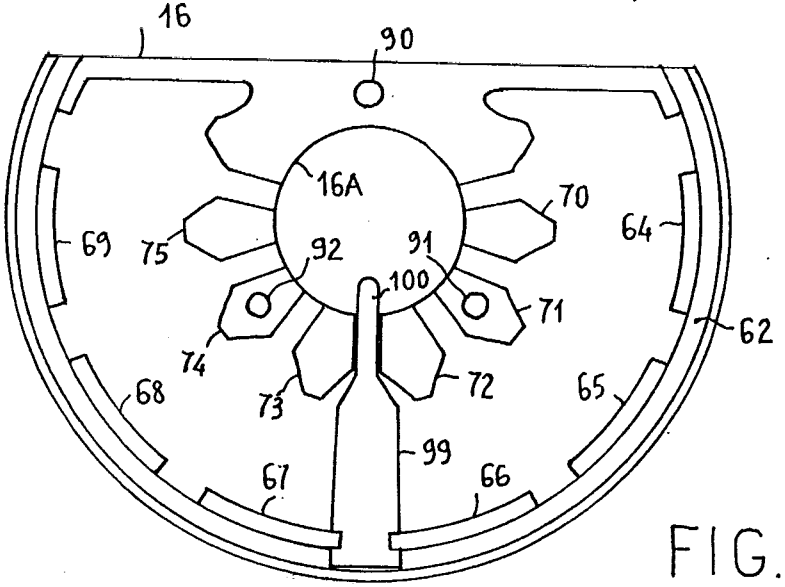
FIG. 5 is a front view of the inner side of the armature retainer used in the electromagnetic assembly.

Retainer 16 has substantially the same shape as disk 10, that is a ring shaped element in form of circular segment with a central opening 16A. As shown in FIG. 5 the perpendicular portion of retainer 16 is provided with a groove 62 receiving a resilient member such as string 63. String 63 may be a rubber string with round section. Along the groove 62, retainer 16 is provided with posts 64, 65, 66, 67, 68, 69 which interpose between adjacent armatures and impose a radial distribution of the armatures. Similar posts 70, 71, 72, 73, 74, 75 are provided internally at the periphery of the central opening, with the double function of imposing a radial distribution of the armature and providing retainer 16 with a contact face to bushing 61. Retainer 16 is fixed to bushing 61 by means of ring-shaped cap 17.

Cap 17 has a suitable number of openings distributed circumferentially on its peripheral portion. Preferably three openings are used; two of them are visible in FIG. 3 and referenced by 80, 81. Each opening receives a screw, such as 83, 84, 85 which is screwed into a corresponding threaded seat of bushing 61. The screws are inserted in the three openings 86, 87, 88 in a resilient ring 89, which is interposed between cap 17 and armature retainer 16, as well as in the three openings 90, 91, 92 in the armature retainer, in correspondence with three internal posts.

Figure 4:
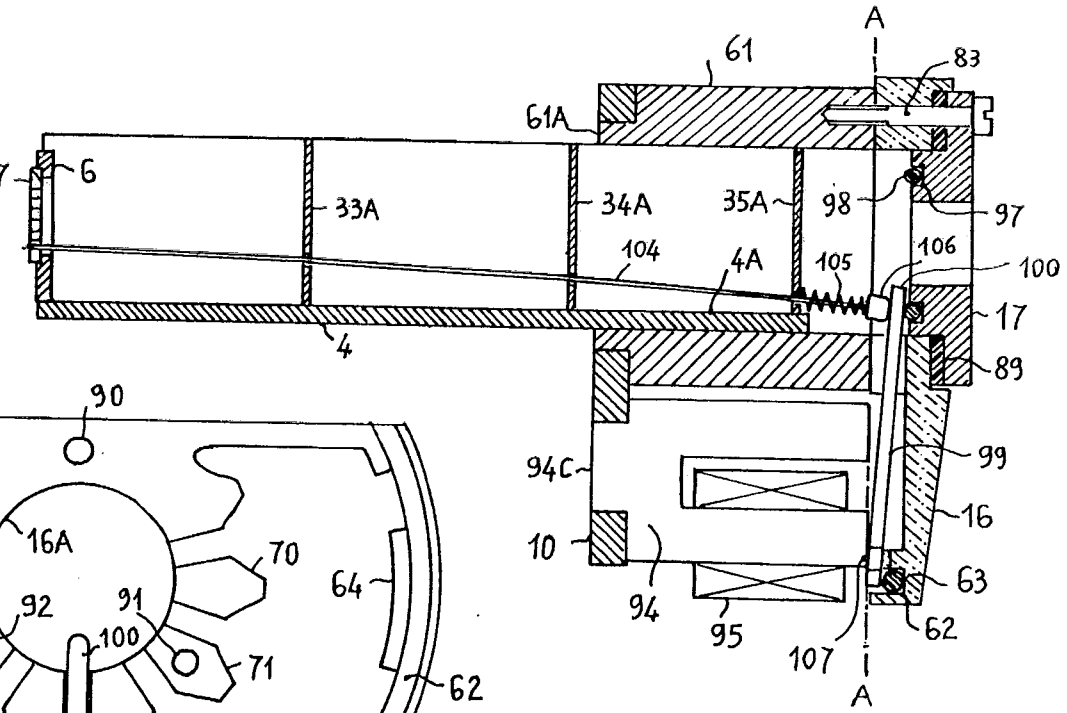
FIG. 4 is a median, side section view of the printing head according to the invention.

The cap 17 is provided with a bushing or cylindrical projection 96 which inserts in the central opening 16A of the armature retainer 16 and has a circular groove 97 which receives a thoroidal resilient member or "O-RING" 98. Such O-RING 98, as shown in FIG. 4, defines a reference surface for the armatures when the electromagnets are de-energized. Another function of such O-RING is to dampen the rebound of the armatures when they return in rest position following de-energization of the electromagnets.

FIG. 3 shows that a plurality of electromagnets are to be mounted in the electromagnet group, but only a single electromagnet 93 is shown. Electromagnet 93 includes a magnetic core 94 which is formed by a pack of generally U-shaped magnetic sheets and having an appendix 94C for insertion in one of the rectangular openings of disk 10, for instance opening 48. A coil 95 is wound around a column of the magnetic core 94 and the magnetic circuit is closed by a movable armature 99. The armature 99 has an extension arm 100 operating as a level arm for the actuation of a needle. The extension arm 100 is inserted between two internal posts 72, 73 of the retainer 16 (see also FiG. 5). Opposite arm 100, the armature is provided with two grooves 101, 102 which receive the side portion of two adjacent external posts of the retainer 16, for instance posts 66, 67 of FIGS. 3, 5. In this way, armature 99 and the other like armatures of the electromagnet group are precisely positioned in their respective seats.

The whole assembly and the function of the several elements appears more clearly from FIG. 4 which is a median section view of the printing head taken from the same point of view of FIG. 1.

FIG. 4 shows clearly a section of the needle assembly with frame 4, needle guide bracket 6, needle guide 7 and diaphragms 33A, 34A, 35A. Appendix 4A of the frame is inserted in bushing 61 which in turn has its end portion 61A inserted in the central opening of supporting disk 10 forming a unitary member. Disk 10 has openings for mounting of the electromagnets. In FIG. 4 an opening is shown, which receives appendix 94C of magnetic core 94. A coil 95 is wound around one of the columns of magnetic core 94 and preferably for avoiding encumbrance problems, on the external one, having in mind the radial mounting of the electromagnets.

By grinding, lapping or using equivalent machining, the end surface of bushing 61, and the end of magnetic cores, such as 94 which define the gap position, lie in a single plane defined by section A—A of FIG. 4. Such plane, hereinafter referred to as A—A plane or air gap plane is parallel to the plane of disk 10 and to the plane of impression.

By such operation any dimensional spread from working tolerances, is avoided in setting the position of the gap in each of the electromagnets. As a consequence the need of individual adjustment of the axial position of the electromagnets as described in the already cited Italian Pat. No. 956,585 is overcome.

In FIG. 4, the armature 99 associated with magnetic core 94 is shown and lays on the core at point 107 of the air gap and is kept in contact with the core by resilient string 63 inserted in groove 62 of retainer 16.

As shown in FIG. 5, the radial position of the armature 99 in the assembly is provided by posts 67, 66 inserted in two symmetrical notches formed in the armature sides, and by the two internal posts 72, 73. Clearly, the other armatures, not shown in the drawings, are retained in an identical way. In FIG. 4 it will be noted that in correspondence to the inner column of core 94, armature 99 is kept away from the magnetic pole by the combined effect of the spring 105 action on the head 106 of needle 104 and therefrom on arm 100 of the armature, as well as the action of the resilient string 62 on the opposite end of the armature 99. The rest position of the armature is defined by O-RING 98, located in groove 97 of cap 17. Other armatures, not shown, are retained in the rest position in an identical way. As shown in FIG. 4, cap 17 is inserted with its inner portion in the central opening of the armature retainer 16. Since the cap 17 is fixed to the bushing 61 by means of a plurality of screws (in FIG. 4 screw 83 is shown), the armature retainer 16 is firmly pressed against the bushing 61 in the A—A plane.

In addition, since a resilient ring 89 is interposed between cap 17 and armature retainer 16 it is possible, by conveniently screwing the screws such as 83, to adjust the distance of cap 17 from the air gap plane A—A without changing the position of the armature retainer 16 and the force exerted by string 62 on the armatures.

In this way it is possible to collectively and precisely adjust the air gap width of the whole electromagnets in the rest position because by changing the axial position of cap 17, the axial position of the O-RING 98 is changed too. The fact that the armature retainer is pressed against bushing 61, through the internal posts, along a circular crown rather wide relative to the external diameter of the armature retainer, provides a steady and stable linkage to the bushing. This is so even in case the electromagnets are disposed in a sector as shown, and therefore cause an eccentrical stress, due to the armature's action against string 63 and consequently on the peripheral portion of the armature retainer. Distribution of the electromagnets in a sector is preferred in order to obtain a better visibility of the printed line. Further it should be noted that the force exerted by the armatures at rest is sustained essentially constant by cap 17.

Several advantages are obtained by the structure of such print head. First of all, the described structure allows for the adjustment of the air gap's width when the armatures are at rest and such width can be made equal for all the air gaps. In this way, optimization of the electrodynamical performances of the electromagnets, in terms of actuation speed, is achieved, and further performances can be made equal for each electromagnet.

After such air gap adjustment, it is possible to adjust the position of bracket 6, so that the needle ends and the rubies' surface are brought in the same plane. In this way the ribbon wear consequent to the protrusion of the needles from the guide surface, with the needles at rest, is avoided.

After such air gap and bracket adjustment, the print head is mounted on the print carriage and its position adjusted so as to have the needle's end at a predetermined distance D from the platen. If during the life of the printer the needles wear, it is possible, by unloosing screws 20 and 26 to advance the whole printing head towards the platen, thus again bringing the ends of the needles to a predetermined distance D from the platen.

Further the above described printing head design allows very easy maintenance and repair. The most frequent failure which occurs is the breaking or seizing of a needle. After removing the printing head from the carriage, it is only necessary to unloose screws 8 and 44 in order to remove the needle guiding assembly from the electromagnet assembly, thereafter replacing the broken or seized needles without need to disassemble the electromagnet group and consequently to re-adjust the air gap width.

Therefore it is clear that by simple and inexpensive means combined together in the inventor's unique print head design, several advantages are achieved in a synergistic way such as: rapid, easy and practical setting up of the printer, obtaining performance uniformity throughout the life of the printer, and ease of maintenance. Such advantages were not possible in prior art print heads, or possible only in part, and then only by means of complex and expensive structures.

I claim:

1. An impact matrix printing head adapted to be mounted on a printing carriage for providing an impression against a platen, including:

a needle guiding assembly, said needle guiding assembly including a plurality of needles;

an electromagnet assembly, said electromagnet assembly including a plurality of electromagnetic structures, each of said plurality of electromagnetic structures including a pole piece and an armature;

said armature having a lever arm acting on one of said plurality of needles to drive said needle towards the platen;

said electromagnet assembly further comprising a supporting ring member provided with a central cylindrical bushing, said supporting ring member including a first locking means to structurally attach said member to the print carriage;

the pole pieces of said plurality of electromagnetic structures being fixed on said supporting ring member radially around said bushing;

a disk shaped armature retainer having a central portion contacting said bushing and a peripheral portion, said peripheral portion having means for positioning said armatures contiguous to said pole pieces;

a circular cap;

second locking means for fixing said cap to said bushing through interposition of said central portion of said armature retainer;

first resilient means interposed between said cap and said central portion of said armature retainer and adjustably compressed by the action of said second locking means;

second resilient means mounted in the central portion of said cap, said second resilient means contacting one end of said armatures, whereby the adjustable compression of said first resilient means allows for the adjustment of the air gap width of said electromagnetic structures, and whereby said first locking means allows for the adjustment of the distance of said electromagnetic assembly from the printing platen.

2. An impact matrix printing head as claimed in claim 1 wherein said central bushing has a free end surface in contact with said central portion of armature retainer and said end surface of said central bushing and the air gaps of said electromagnetic structures lay in a same plane.

3. An impact matrix printing head as claimed in claim 1 wherein said needle guiding assembly comprises:

a frame mounted on said electromagnet assembly;

a needle guide for guiding a printing end of said needles;

and locking means for adjustably locking said needle guide to said frame, whereby the distance between said needle guide and said air gap plane is adjustable.

* * * * *